US005898150A

United States Patent [19]

Gallix et al.

[11] Patent Number: 5,898,150

[45] Date of Patent: Apr. 27, 1999

[54] GAS-BLAST HIGH-VOLTAGE CIRCUIT-BREAKER

[75] Inventors: Bernard Gallix, Decines; Roger Ledru, Tignieu; Antoine Tolossi, Beynest, all of France

[73] Assignee: Gec Alsthom & D Sa, Paris, France

[21] Appl. No.: 08/853,254

[22] Filed: May 9, 1997

[30] Foreign Application Priority Data

May 13, 1996 [FR] France ..... 96 05912

[51] Int. Cl.[6] ..... H01H 33/91

[52] U.S. Cl. ..... 218/66; 218/60

[58] Field of Search ..... 218/43, 57, 59, 218/60–64, 66, 68, 72

[56] References Cited

U.S. PATENT DOCUMENTS

| | | | |
|---|---|---|---|
| 2,696,274 | 12/1954 | Old | 183/21 |
| 4,458,120 | 7/1984 | Korner et al. | 218/66 |
| 4,491,706 | 1/1985 | Berg | 218/66 |
| 4,511,775 | 4/1985 | Korner et al. | 218/57 |
| 4,556,767 | 12/1985 | Egli et al. | 218/59 |
| 4,609,798 | 9/1986 | Nicoloso | 218/43 |
| 5,001,314 | 3/1991 | Thuries et al. | 218/59 |

FOREIGN PATENT DOCUMENTS

| | | | |
|---|---|---|---|
| 0126929 A2 | 12/1984 | European Pat. Off. | H01H 33/815 |
| 0475270 A2 | 3/1992 | European Pat. Off. | H01H 33/81 |
| 0591039 A1 | 4/1994 | European Pat. Off. | H01H 33/81 |

*Primary Examiner*—Michael A. Friedhofer

*Attorney, Agent, or Firm*—Sughrue, Mion, Zinn, Macpeak & Seas, PLLC

[57] ABSTRACT

A gas-blast circuit-breaker includes a jacket filled with a dielectric gas. A mobile arc contact cooperates with a fixed arc contact within the jacket. The mobile arc contact is part of a mobile contact assembly which is displaceable axially in the jacket between a closed position and an open position. The mobile contact assembly includes a first tube carrying the mobile arc contact and a second tube, which is coaxial with the first tube, carrying a mobile permanent contact with a gas blast nozzle coupled thereto. A ring joins the first tube and the second tube to define a gas-blast chamber and a compression chamber on opposite sides of the ring. The compression chamber communicates with the gas-blast chamber. An annular piston having an annular recess closes the compression chamber. A compression spring influences the annular piston against a fixed front stop. A floating ring is moveably mounted on the first tube between a front abutment position in which the floating ring abuts a fixed washer and a rear abutment position in which the floating ring abuts a rear retaining member, the floating ring being housed in the annular recess when the annular piston abuts the fixed front stop. The floating ring has an orifice which is blocked by the fixed washer when the floating ring is in the front abutment position.

2 Claims, 7 Drawing Sheets

GAS-BLAST HIGH-VOLTAGE CIRCUIT-BREAKER

BACKGROUND OF THE INVENTION

Field of the Invention

The present invention concerns a gas-blast circuit-breaker including a jacket filled with a pressurized dielectric gas, two cooperating arc contacts, one of which is part of a mobile contact assembly attached to an operating member and adapted to be displaced axially in the jacket between a closed position and an open position, the mobile contact assembly including a first tube carrying the mobile arc contact at its end and a second tube coaxial with the first tube, carrying a mobile permanent contact at its end and delimiting, on respective opposite sides of a ring joining the first tube and the second tube, a gas-blast chamber closed by a gas-blast nozzle and a compression chamber communicating with the gas-blast chamber and closed by a piston.

Patent application 2 696 274 describes a circuit-breaker of this kind.

In the above prior art document, the piston is semi-mobile and means are provided for immobilizing the piston during a first part of the displacement of the mobile contact assembly during opening of the circuit-breaker and means are further provided for entraining the same piston in the axial direction during a second part of the displacement of this assembly.

The means for entraining the mobile contact assembly in the axial direction during this second part of the displacement comprise an entrainment member attached to the mobile contact assembly which entrains a stop attached to the piston. This stop is disposed on the path of the entrainment member. During the first part of the displacement, the piston is held in position by a spring placed between the piston and the entrainment member and pushing on the piston which is held by a ring "abutted" against a fixed member, the ring being attached to a tube in turn attached to the piston. During this first part of the displacement the entrainment member slides in a slot in the tube connecting the piston to the ring until it abuts the end of the slot, thereafter training the piston during the second part of the displacement.

In an arrangement of this kind the spring acting on the semi-mobile piston applies a permanent force to the operating rod and this leads to an increase in the operating energy required.

U.S. Pat. No. 4,556,767 describes a pressurized gas interrupter having a slightly different structure in that there is no second tube but instead an annular piston 12 coupled to a tube 8 carrying a rated current contact 5 and sliding directly in a cylindrical outer housing 14.

However, the above document describes the use of a piston 15 sliding freely between a stop 16 attached to the housing 14 and a compression spring 17.

This arrangement automatically withdraws the free piston as a result of the increase in the pressure in the compression chamber at the time of the opening maneuver and thereby limits the increase in pressure, thereby providing the advantages of the semi-mobile piston of the first document cited in the introduction but without the operating rod being subjected to any additional force.

When the arc contacts have separated and the gas blast has escaped, the pressure falls and the thrust of the compression spring returns the free piston to its position against said fixed front stop.

Unfortunately, with a free piston of this kind, this return movement is accomplished with non-negligible kinetic energy, producing an impact on the fixed front stop and the parts attaching this stop, which can cause breakages.

Accordingly, an aim of the invention is to propose a circuit-breaker having a structure as defined in the introduction incorporating a free piston with its attendant advantages but overcoming the disadvantage cited hereinabove.

SUMMARY OF THE INVENTION

Accordingly, the invention consists in Gas-blast circuit-breaker including a jacket filled with a pressurized dielectric gas, two cooperating arc contacts, one of which is part of a mobile contact assembly attached to an operating member and adapted to be displaced axially in the jacket between a closed position and an open position, the mobile contact assembly including a first tube carrying the mobile arc contact at its end and a second tube coaxial with the first tube, carrying a mobile permanent contact at its end and delimiting, on respective opposite sides of a ring joining the first tube and the second tube, a gas-blast chamber closed by a gas-blast nozzle and a compression chamber communicating with the gas-blast chamber and closed by a piston, wherein said piston is annular and disposed between said two tubes and is freely slidable between a fixed front stop and a compression spring one end of which bears on the piston and the other end of which has a fixed bearing point on the opposite side of said fixed front stop from said arc contacts, said piston having on the side opposite that on which the compression spring bears an annular recess in which a ring is housed in the position with said piston bearing against said front stop, said ring floating between a fixed washer attached to said front stop and a rear retaining member and having at least one orifice in it blocked by said fixed washer when it is in a front abutment position, thereby forming a check valve enabling introduction of gas into said recess on withdrawal of the piston due to the pressure of the gas in said compression chamber during opening of the circuit-breaker, the return movement of the piston towards the front due to the thrust of said compression spring being damped by the gas cushion compressed by said ring entering said recess.

Other features of the present invention will emerge from the following description with reference to the accompanying drawings of one embodiment of the invention.

DETAILED DESCRIPTION OF THE PREFERRED EMBODIMENT

The following description refers by way of example to a circuit-breaker having an insulative jacket for each phase. Of course, the invention applies equally well to circuit-breakers with a grounded metal jacket having a separate jacket for each phase or a single jacket for all three phases.

Figure 1:
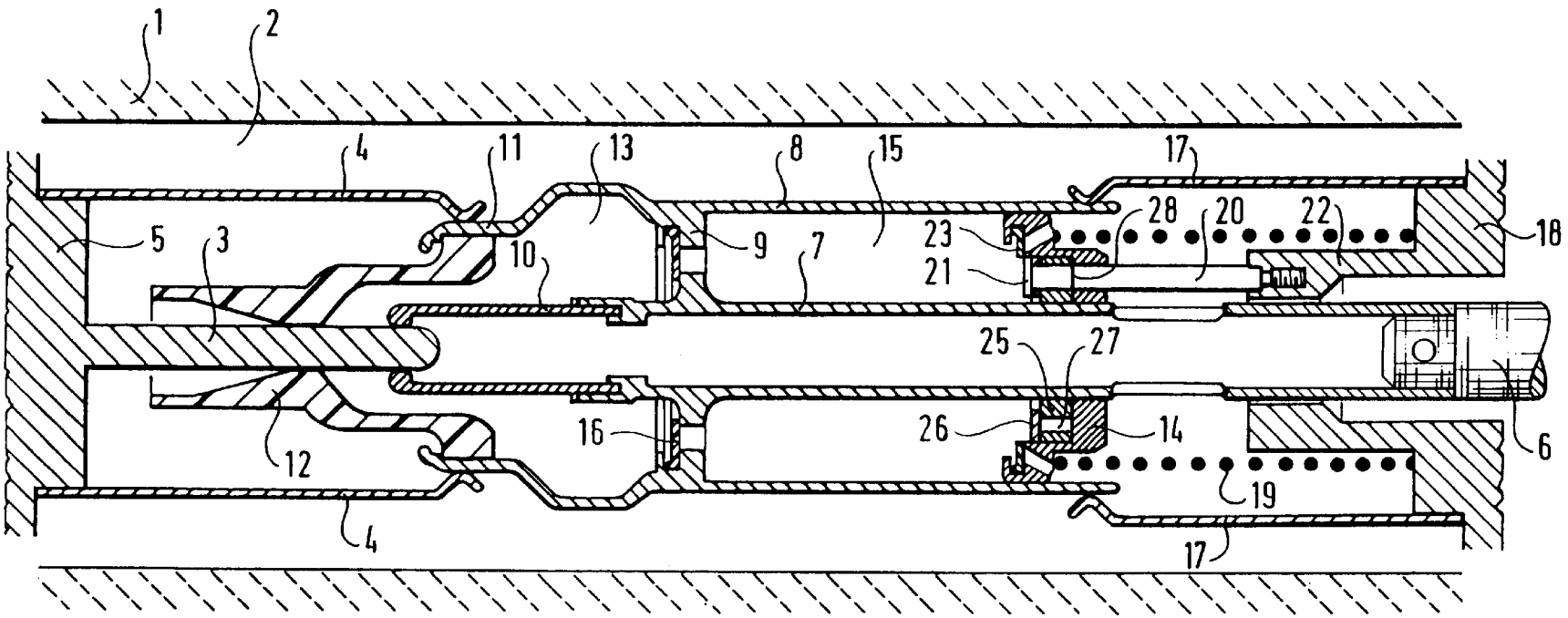
FIGS. 1 through 6 are fragmentary views of a circuit-breaker of the invention in its various configurations during an opening maneuver from the closed state shown in FIG. 1 to the fully open state shown in FIG. 6.

Referring to FIG. 1, an insulative, preferably porcelain jacket 1 delimits an expansion chamber 2 filled with a gas having good dielectric properties, for example sulfur hexafluoride, at a pressure of a few bars.

The circuit-breaker comprises a fixed assembly and a mobile contact assembly.

The fixed assembly comprises an arc contact 3 and a fixed permanent contact made up of a circular series of fingers 4. The fixed arc contact 3 and the permanent contact 4 are connected to a first terminal 5.

The mobile contact assembly comprises an insulative operating member 6 passing through the chamber 2 and connected at one end to a mechanism that is not shown. Its other end is connected to a metal mobile contact assembly comprising two coaxial tubes 7 and 8. These two tubes 7 and 8 are joined together by a metal ring 9. The inner tube 7 carries the mobile arc contact 10 and the outer tube 8 carries the mobile permanent contact 11 the outside edge of which cooperates with the fingers 4 of the fixed permanent contact in the closed position of the circuit-breaker as shown in FIG. 1. An insulative material gas-blast nozzle 12 is coupled to the tubular mobile permanent contact 11.

The space between the mobile permanent contact 11, the mobile arc contact 10, the ring 9 and the gas blast nozzle 12 constitutes a gas-blast chamber 13. The tubes 7 and 8, an annular piston 14 between the two tubes and the metal ring 9 delimit a compression chamber 15. This compression chamber 15 is separated from the gas-blast chamber 13 by the metal ring 9 fitted with one-way valves 16 enabling gas to pass from the compression chamber 15 to the gas-blast chamber 13.

Permanent contact fingers 17 coupled to a back plate 18 connected to a second terminal, not shown, are in sliding electric contact with the outer tube 8.

The annular piston 14 slides freely between a fixed front stop and a compression spring 19 one end of which bears on the piston and the other end of which bears against the fixed back plate 18.

The annular piston 14 slides along three fixed tie-rods 20 (only one of which can be seen in the figures), the head 21 of which provides a fixed front stop for the piston 14. The fixed tie-rods 20 are fixed to a fixed sleeve 22 coupled to the back plate 18. The sleeve 22 guides the spring 19.

Figure 7:
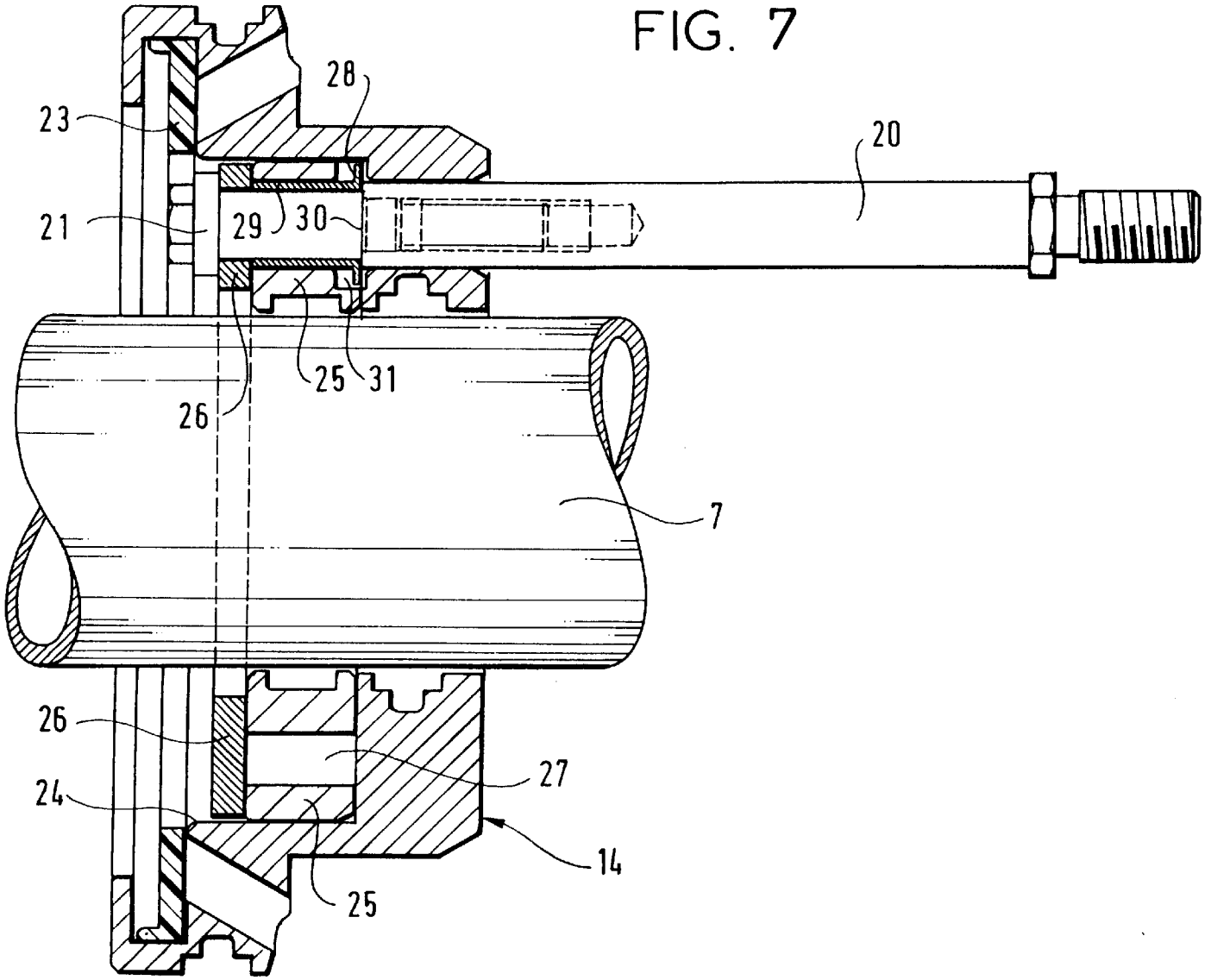
FIG. 7 is an enlarged view of a detail from the previous figures showing the piston with its recess and the ring enabling damping on the return movement of the piston.

The piston 14 and the means employed to damp the impact caused by the spring 19 returning the piston to the front at the end of opening of the circuit-breaker when the pressure in the compression chamber 15 has fallen will now be described in more detail with reference to FIG. 7.

The piston 14 is fitted with a valve 23 allowing gas to pass from the expansion chamber 2 to the compression chamber 15 but not in the opposite direction. It further includes an annular recess 24 that can be seen clearly in FIGS. 3, 4 and 5. With the circuit-breaker at rest, i.e. when it is closed or fully open, as shown in FIGS. 1, 6 and in the position of the piston relative to the tie-rod 20 shown in FIG. 7, a floating ring 25 is at the back of this recess 24, pushed by the piston against a fixed washer 26 which in turn bears against the head 21 of the tie-rods 20.

The floating ring 25 has three holes at 120° for the tie-rods 20 and orifices 27 between the holes for the tie-rods. The floating ring 25 is mounted between the fixed washer 26 and a rear retaining member 28 in the form of a flange on a bush 29. The bush 29 is immobilized on the tie-rod 20 in the axial direction by a shoulder 30 on the tie-rod and by the head 21 of the tie-rod. The head 21 is in fact the head of a screw clamping the fixed washer 26 and the bush 29 against the shoulder 30 on the tie-rod 20.

To enable the floating ring 25 to move axially between the washer 26 and the flange 28 on the bush 29, it includes a recess 31 around each tie-rod 20 passing through it. This recess is on the same side as the flange 28.

In the position shown in FIGS. 1, 5, 6 and 7, the three orifices 27 are blocked by the washer 26.

Figure 2:
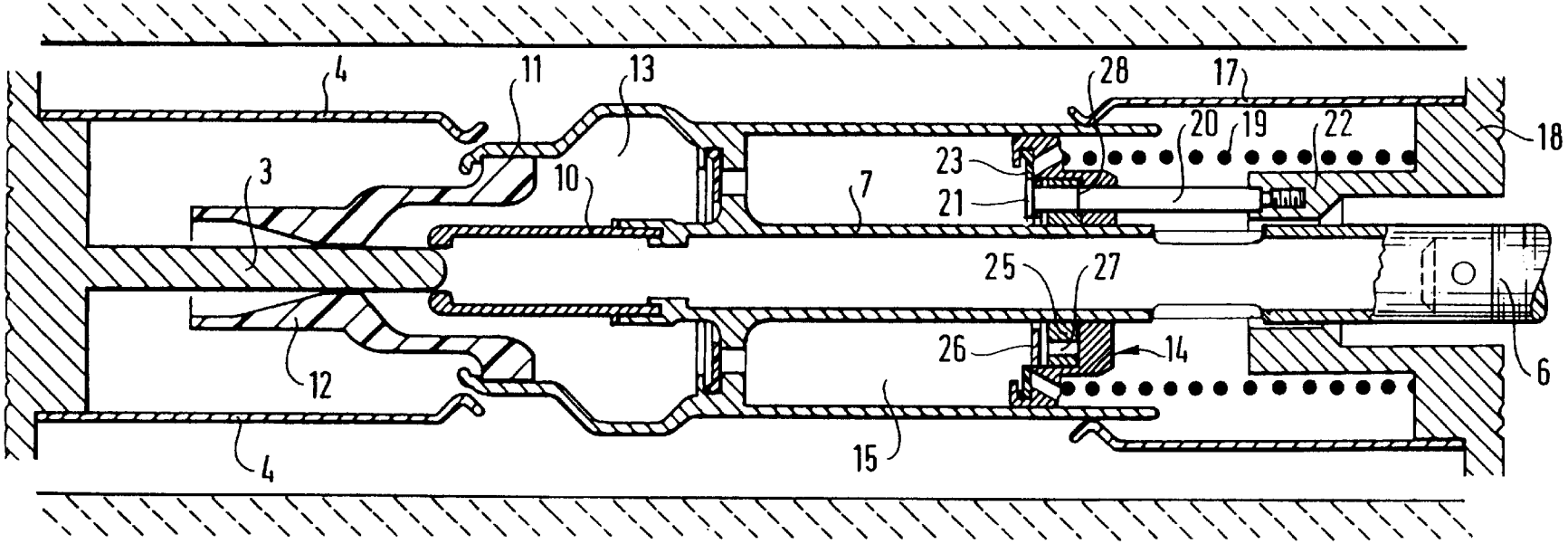
Figure 3:
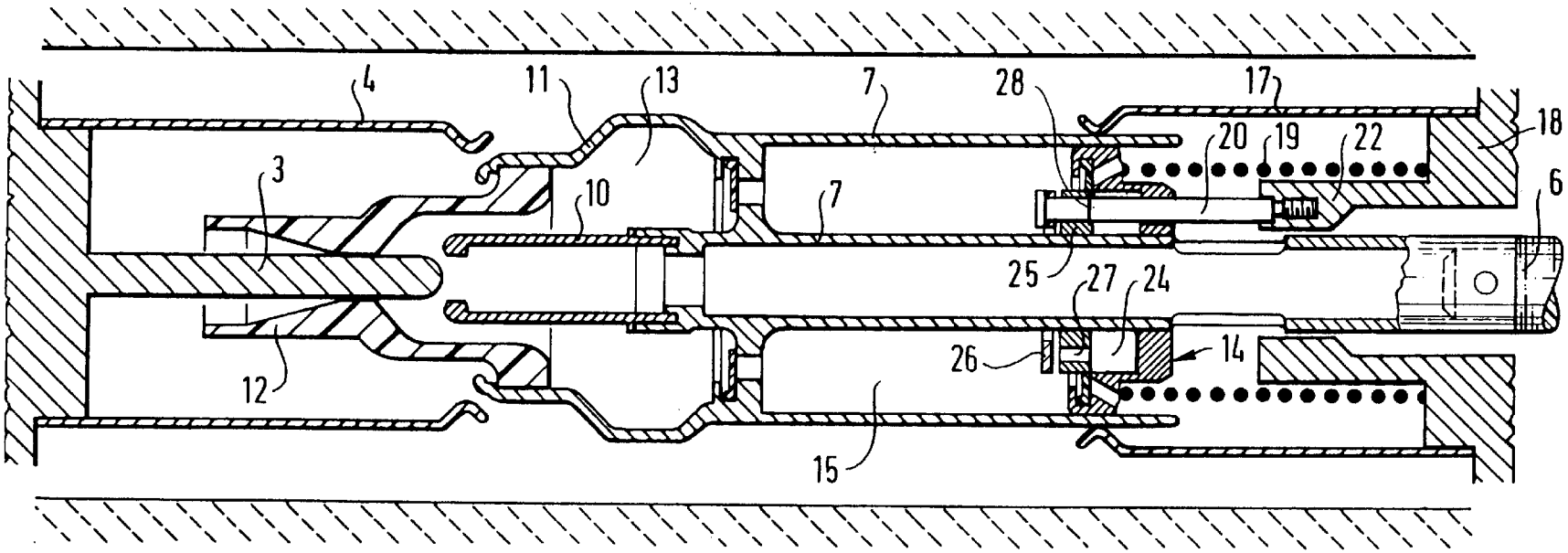

However, when the piston 14 is withdrawn (FIG. 2), as the pressure rises in the compression chamber 15 due to the movement towards the right of the mobile assembly 6 through 11, the floating ring bears against the flange 28, uncovering the orifices 27 and allowing gas to enter the recess 24 as withdrawal of the piston 14 continues (FIG. 3).

Figure 4:
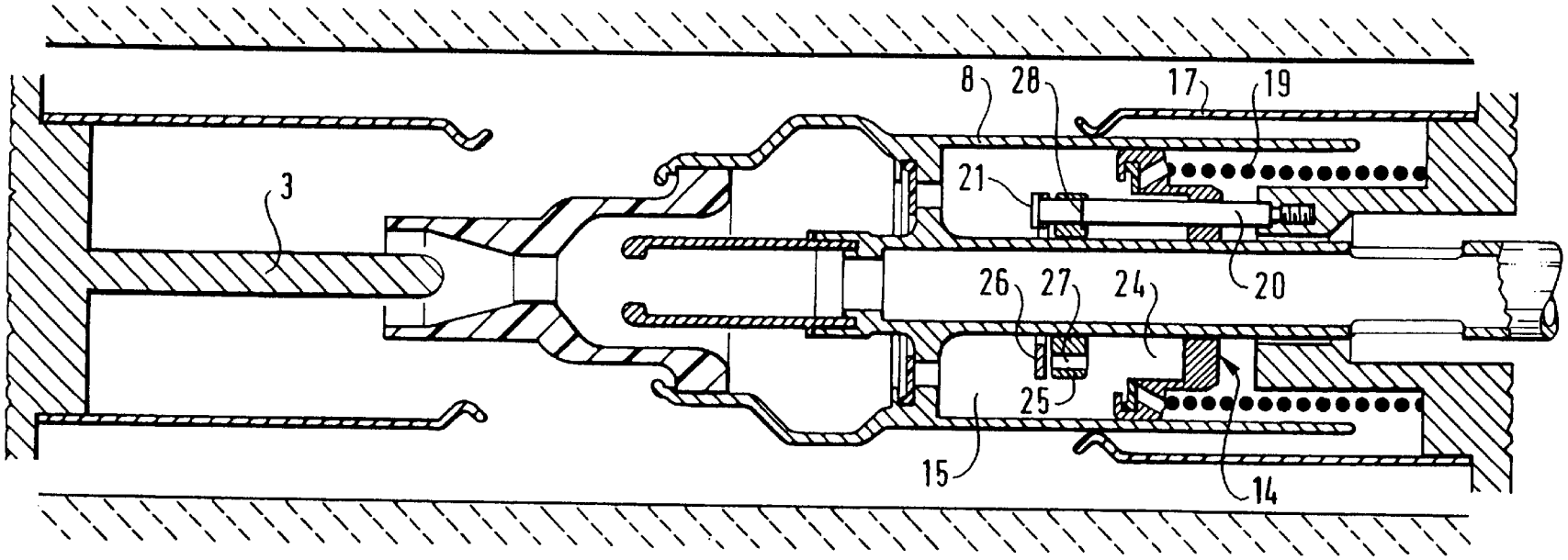

In FIG. 4, the piston is in the fully withdrawn position.

Figure 5:
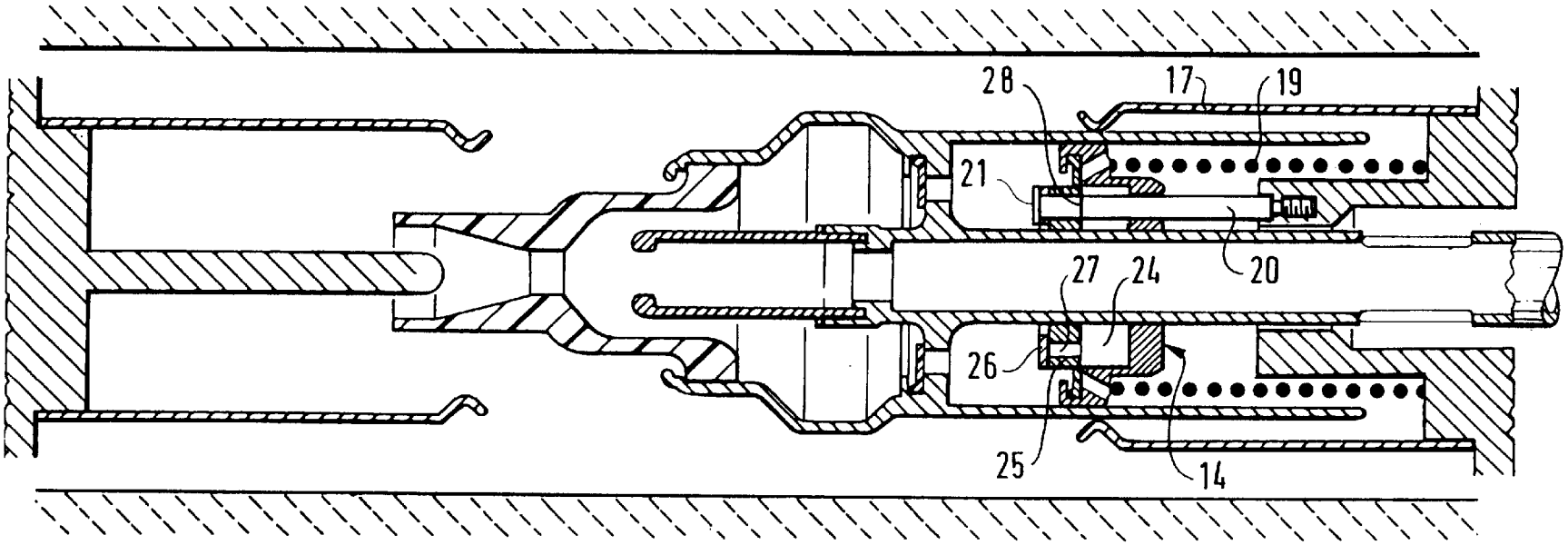
Figure 6:
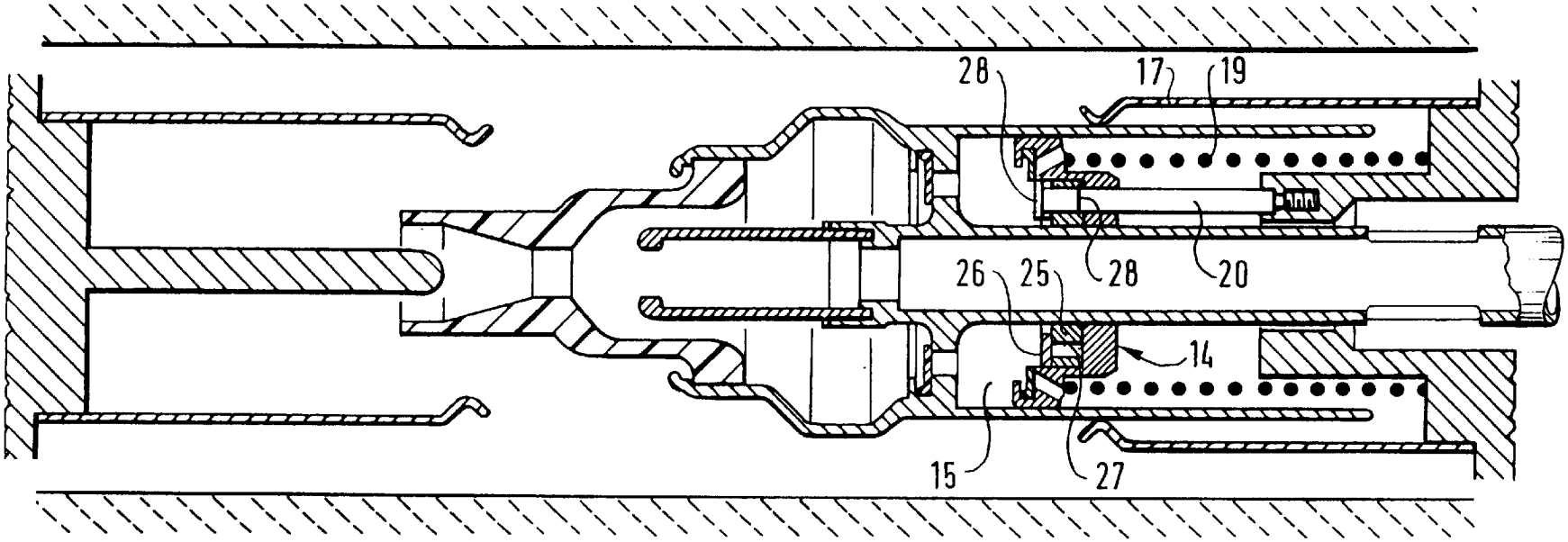

In FIG. 5, the circuit-breaker is open, the gas has escaped into the expansion chamber 2 and the pressure in the compression chamber 15 has dropped suddenly, the spring 19 thrusting the piston sharply forward, but as soon as the floating ring 25 enters the recess 24 it is pushed against the fixed washer 26, blocking the orifices 27, and the gas cushion contained in the recess 24 strongly damps the end of the return movement of the piston against the ring 25, bearing against the washer 26 and the latter bearing against the heads 21 of the tie-rods 20 (FIG. 6).

What is claimed is:

1. A gas-blast circuit-breaker, comprising:

a jacket filled with a dielectric gas;

a fixed arc contact disposed in said jacket;

a mobile contact assembly disposed in said jacket for axial displacement between a closed position and an open position, said mobile contact assembly including a first tube carrying a mobile arc contact which cooperates with said fixed arc contact when said mobile contact assembly is in said closed position, a second tube coaxial with said first tube, said second tube carrying a mobile permanent contact with a gas blast nozzle coupled thereto, said gas blast nozzle receiving said fixed arc contact when said mobile contact assembly is in said closed position, a ring joining said first tube and said second tube, a gas-blast chamber defined between said gas-blast nozzle, said ring, said mobile arc contact, and said mobile permanent contact, and a compression chamber defined between said ring, and said first and said second tubes, said compression chamber communicating with said gas-blast chamber;

an annular piston moveably disposed between said first and said second tubes to close said compression chamber, said annular piston having a front face facing toward said compression chamber, said front face having an annular recess, said annular piston having an opposed back face;

a compression spring having a first end bearing against said opposed back face of said annular piston and a second end bearing against a fixed bearing surface that faces said opposed back face, said compression spring influencing said annular piston against a fixed front stop; and a floating ring moveably mounted on said first tube between a front abutment position in which said floating ring abuts a fixed washer attached to said fixed front stop and a rear abutment position in which said floating ring abuts a rear retaining member, said floating ring being housed in said annular recess when said annular piston abuts said fixed front stop, said floating ring having an orifice which is blocked by said fixed washer when said floating ring is in said front abutment position;

wherein said floating ring forms a check valve enabling introduction of said dielectric gas into said annular recess upon withdrawal of said annular piston away from said fixed front stop and against said influence of said compression spring due to a pressure increase of said dielectric gas in said compression chamber during movement of said mobile contact assembly toward said open position, and wherein a return movement of said annular piston towards said fixed front stop, due to said influence of said compression spring and due to said dielectric gas escaping from said gas-blast chamber via said gas blast nozzle once said fixed arc contact is removed from said gas blast nozzle, is damped by a gas cushion compressed by said floating ring entering said annular recess.

2. The circuit-breaker claimed in claim 1, wherein said annular piston slides on a fixed tie-rod extended from said fixed bearing surface said fixed tie-rod having a head which provides said fixed front stop for said annular piston, and wherein said rear retaining member for said floating ring is situated on said tie-rod.

* * * * *